US010101681B2

(12) United States Patent
Tagawa et al.

(10) Patent No.: US 10,101,681 B2
(45) Date of Patent: Oct. 16, 2018

(54) TONER

(71) Applicant: CANON KABUSHIKI KAISHA, Tokyo (JP)

(72) Inventors: Reo Tagawa, Susono (JP); Yoshihiro Nakagawa, Numazu (JP); Naoya Isono, Suntou-gun (JP); Harumi Takada, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/474,416

(22) Filed: Mar. 30, 2017

(65) Prior Publication Data

US 2017/0293235 A1 Oct. 12, 2017

(30) Foreign Application Priority Data

Apr. 11, 2016 (JP) ..... 2016-078791

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 9/093*** | (2006.01) |

(52) U.S. Cl.

CPC ..... *G03G 9/0825* (2013.01); *G03G 9/0806* (2013.01); *G03G 9/0812* (2013.01); *G03G 9/08711* (2013.01); *G03G 9/08755* (2013.01); *G03G 9/0904* (2013.01); *G03G 9/0918* (2013.01); *G03G 9/09328* (2013.01); *G03G 9/09364* (2013.01); *G03G 9/09378* (2013.01); *G03G 9/09392* (2013.01)

(58) Field of Classification Search

CPC ..... G03G 9/0825; G03G 9/08755; G03G 9/09378; G03G 9/0806; G03G 9/09364; G03G 9/09328; G03G 9/0918; G03G 9/0904; G03G 9/0812; G03G 9/09392; G03G 9/08711

See application file for complete search history.

(56) References Cited

U.S. PATENT DOCUMENTS

| | | | | |
|---|---|---|---|---|
| 4,960,669 | A | 10/1990 | Mori et al. | |
| 6,569,589 | B2 | 5/2003 | Inaba et al. | |
| 8,021,814 | B2 * | 9/2011 | Hagi ..... | G03G 9/081 430/108.8 |
| 8,039,185 | B2 | 10/2011 | Matsumoto et al. | |
| 8,367,289 | B2 | 2/2013 | Isono et al. | |
| 8,440,382 | B2 | 5/2013 | Isono et al. | |
| 8,497,054 | B2 | 7/2013 | Sugiyama et al. | |
| 8,603,712 | B2 | 12/2013 | Aoki et al. | |
| 8,652,737 | B2 | 2/2014 | Handa et al. | |
| 8,741,519 | B2 | 6/2014 | Watanabe et al. | |
| 8,778,581 | B2 | 7/2014 | Nonaka et al. | |

(Continued)

FOREIGN PATENT DOCUMENTS

| | | |
|---|---|---|
| JP | 2005-266621 | 9/2005 |
| JP | 2007-249082 | 9/2007 |

(Continued)

*Primary Examiner* — Thorl Chea

(74) *Attorney, Agent, or Firm* — Fitzpatrick Cella Harper and Scinto

(57) ABSTRACT

Provided is a toner having a toner particle containing a binder resin and a wax, wherein the wax concentrations near the outermost surface of the toner and in the surface layer region below the outermost surface are controlled, so that the wax moves with high efficiency to near the outermost surface during heating.

7 Claims, 1 Drawing Sheet

(56) References Cited

U.S. PATENT DOCUMENTS

| | | | | |
|---|---|---|---|---|
| 8,828,633 | B2 | 9/2014 | Itabashi et al. | |
| 8,835,086 | B2 | 9/2014 | Watanabe et al. | |
| 8,846,284 | B2 | 9/2014 | Kinumatsu et al. | |
| 9,158,216 | B2 | 10/2015 | Shimano et al. | |
| 9,377,705 | B2 | 6/2016 | Shimano et al. | |
| 9,383,668 | B2 | 7/2016 | Noji et al. | |
| 9,429,860 | B2 | 8/2016 | Kinumatsu et al. | |
| 9,500,972 | B2 | 11/2016 | Tanaka et al. | |
| 9,551,947 | B2 | 1/2017 | Hiroko et al. | |
| 9,575,424 | B2 | 2/2017 | Nakagawa et al. | |
| 9,599,919 | B2 | 3/2017 | Isono et al. | |
| 2007/0134577 | A1* | 6/2007 | Tong | G03G 9/0804 430/108.1 |
| 2009/0297225 | A1* | 12/2009 | Yamada | G03G 9/0819 399/252 |
| 2013/0164670 | A1* | 6/2013 | Nakayama | G03G 9/0804 430/109.4 |
| 2015/0099222 | A1 | 4/2015 | Terui et al. | |
| 2015/0153669 | A1 | 6/2015 | Yoshida et al. | |
| 2015/0331344 | A1 | 11/2015 | Tominaga et al. | |
| 2015/0370189 | A1 | 12/2015 | Tanaka et al. | |
| 2016/0334727 | A1 | 11/2016 | Tanaka et al. | |
| 2016/0349640 | A1 | 12/2016 | Tanaka et al. | |
| 2017/0052465 | A1 | 2/2017 | Shimano et al. | |
| 2017/0060011 | A1 | 3/2017 | Nakagawa et al. | |

FOREIGN PATENT DOCUMENTS

| | | |
|---|---|---|
| JP | 2011-158758 | 8/2011 |
| JP | 5446792 | 3/2014 |
| JP | 5634252 | 12/2014 |

* cited by examiner

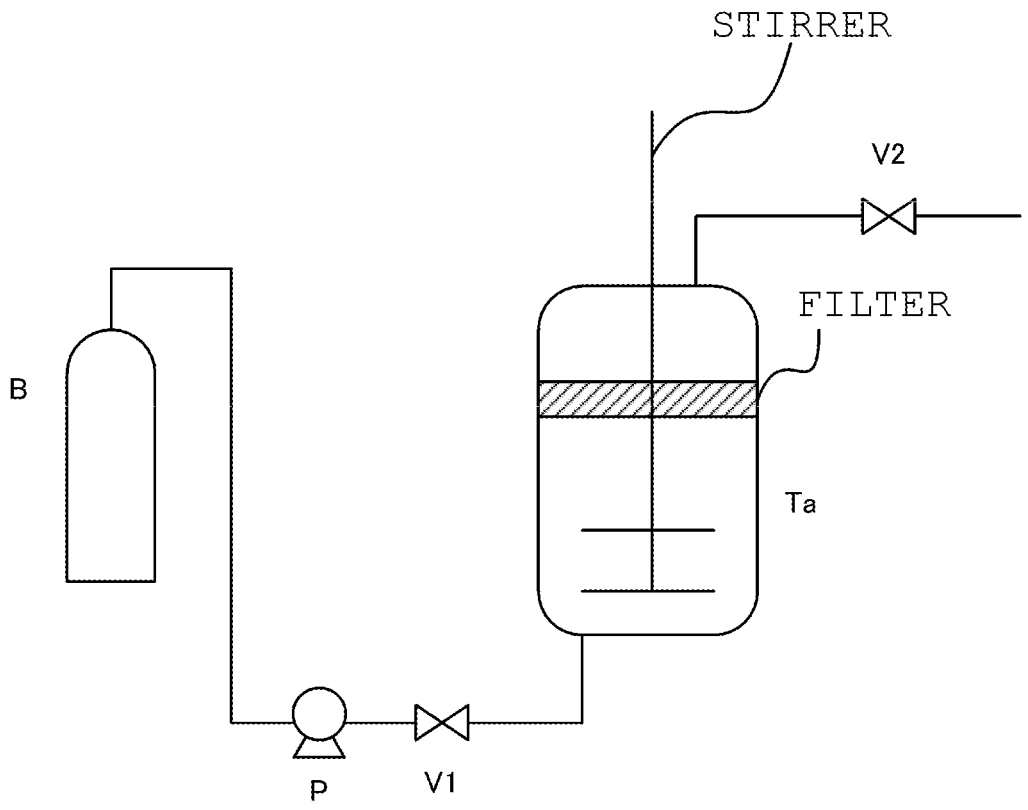
STIRRER
V2
FILTER
B
Ta
P
V1

TONER

BACKGROUND OF THE INVENTION

Field of the Invention

The present invention relates to a toner for use in recording methods employing electrophotographic methods, electrostatic recording methods and toner jet recording methods.

Description of the Related Art

In recent years, printers and copiers have been subject to demands for reductions in power consumption. The toners used in printers and copiers are fixed on media by heating and melting. To reduce power consumption, it is necessary to achieve so-called low-temperature fixability, in which the toner is fixed to the medium at a lower temperature without adverse effects. Various technical approaches have been attempted to meet these demands. One of these is to control the position of a wax in the toner interior. A wax contained in a toner is exuded on the toner surface when the toner is heated and melted, and functions to control the problem of melted toner adhering to fixing members such as rollers. Oil-less fixing can be achieved by means of this effect. In the case of a low-temperature fixing process, however, because the melted wax is less fluid and the toner is less likely to be deformed by the melting process, the exudation property of the wax is reduced, making the toner more difficult to separate from the fixing member. This has led to problems of fixing defects.

In order to facilitate wax exudation even in low-temperature fixing processes, toners have been developed in which the wax is distributed eccentrically near the surface layer of the toner.

Japanese Patent No. 5634252 discloses a toner in which a large amount of wax is located near the outermost toner surface (to a depth of 0.3 μm from the surface) as opposed to the surface region below the outermost surface (up to a depth of 1.0 μm from the surface).

Japanese Patent No. 5446792 discloses a toner in which wax exudation near the outermost toner surface (up to a depth of 0.3 μm from the surface) during heating is facilitated by causing the wax to move to near the toner surface layer during the manufacturing process.

SUMMARY OF THE INVENTION

However, when a toner such as that of Japanese Patent No. 5634252 is exposed to an extreme high-temperature environment over a long period of time, storability may not be satisfactory because the low-melting-point component of the wax near the outermost surface may melt out of the toner. In the case of a toner such as that described in Japanese Patent No. 5446792 in which a large amount of wax is located near the surface layer in order to improve the exudation property, the mechanical strength of the outer layer is reduced, and it may adhere to a member when external force is applied, leading to image defects.

That is, in order to obtain a toner that does not cause image defects while also improving heat-resistant storability, the wax concentration near the surface layer must be controlled appropriately from the standpoint of mechanical strength and wax exudation during heating. However, such a toner has yet to be proposed.

It is an object of the present invention to provide a toner that is unlikely to cause image defects even in low-temperature fixing processes, and that also has superior heat-resistant storability because the amount of wax in the surface region is not excessive and the wax moves efficiently to near the toner surface during heating.

In attempting to resolve the problems described above, the inventors discovered that it was necessary to control the wax densities near the outermost toner surface and in the surface region below the outermost surface, and to move the wax efficiently to near the outermost surface during heating.

That is, the present invention is a toner comprising a toner particle containing a binder resin and a wax, wherein the toner satisfies the following formulae (1) to (3):

$$Ps/Pd \leq 0.90 \quad \text{Formula (1)}$$

$$2.20 \leq Ph/Pd \quad \text{Formula (2)}$$

$$0.50 \leq Pd \leq 3.00 \quad \text{Formula (3).}$$

In Formulae (1) to (3),

Pd represents the intensity of the highest absorption peak in the range of 2843 $cm^{-1}$ to 2853 $cm^{-1}$ when the intensity of the highest absorption peak in the range of 3022 $cm^{-1}$ to 3032 $cm^{-1}$ is set to 1.00 in an FT-IR spectrum of the toner obtained by the ATR (attenuated total reflectance) method with an infrared light-incidence angle of 45° using diamond as the ATR crystal;

Ps represents the intensity of the highest absorption peak in the range of 2843 $cm^{-1}$ to 2853 $cm^{-1}$ when the intensity of the highest absorption peak in the range of 3022 $cm^{-1}$ to 3032 $cm^{-1}$ is set to 1.00 in an FT-IR spectrum of the toner obtained by the ATR method with an infrared light-incidence angle of 45° using germanium as the ATR crystal; and Ph represents the intensity of the highest absorption peak in the range of 2843 $cm^{-1}$ to 2853 $cm^{-1}$ when the intensity of the highest absorption peak in the range of 3022 $cm^{-1}$ to 3032 $cm^{-1}$ is set to 1.00 in an FT-IR spectrum of a toner sample obtained by the ATR method with an infrared light-incidence angle of 45° using germanium as the ATR crystal, and the toner sample is obtained by heating the toner at 150° C. for 0.10 seconds and then leaving it to cool to 25° C.

A toner that has excellent heat-resistant storability and is unlikely to cause image defects even in low-temperature fixing processes is provided by the present invention.

Further features of the present invention will become apparent from the following description of exemplary embodiments (with reference to the attached drawings).

BRIEF DESCRIPTION OF THE DRAWINGS

FIG. 1 is a model drawing of an apparatus for performing a treatment step of exposing a toner particle to carbon dioxide.

DESCRIPTION OF THE EMBODIMENTS

Embodiments of the invention are explained below.

Unless otherwise specified, numerical ranges such as "at least A and no more than B" or "A to B" in the present invention include the minimum and maximum values at either end of the range.

The toner of the invention is a toner comprising a toner particle containing a binder resin and a wax, wherein both low-temperature fixability and heat-resistant storability are obtained by controlling the wax concentration near the surface layer of the toner.

The wax concentration is evaluated using intensity in the infrared absorption spectrum as measured by infrared spectroscopy. Because infrared spectroscopy can detect wax compatibilized with the binder resin and fine wax domains that are difficult to detect by other methods, it is especially desirable as a method for evaluating wax concentrations near the outermost surface and in the surface region.

An FT-IR spectrum obtained by the ATR method is used to evaluate the wax concentration near the toner surface layer. In the ATR method, the depth of penetration of infrared light into a sample can be controlled by means of the infrared light incidence angle and the refractive index of the ATR crystal in contact with the sample, making it desirable for analyzing both components near the outermost surface of the sample and components in the surface region below the outermost surface. By using germanium (refractive index 4.0) as the ATR crystal and measuring with an infrared light incidence angle of 45°, it is possible to obtain an FT-IR spectrum extending from the surface of the toner to a depth of 0.3 μm in the direction of the toner center within the frequency range used in the present invention. This spectrum can be considered as the spectrum of near the outermost surface of the toner.

By using diamond (refractive index 2.4) as the ATR crystal and measuring with an infrared light incidence angle of 45° C., moreover, it is possible to obtain a FT-IR spectrum extending from the surface of the toner to a depth of 1.0 μm in the direction of the toner center within the frequency range used in the present invention. This spectrum can be considered as the spectrum of the surface region below the outermost surface of the toner.

Specifically, when the intensity of the highest absorption peak in the range of 3022 $cm^{-1}$ to 3032 $cm^{-1}$ is set to 1.00 in an FT-IR spectrum of the toner obtained by the ATR method with an infrared light incidence angle of 45° using diamond as the ATR crystal, the intensity of the highest absorption peak in the range of 2843 $cm^{-1}$ to 2853 $cm^{-1}$ is called Pd.

Furthermore, when the intensity of the highest absorption peak in the range of 3022 $cm^{-1}$ to 3032 $cm^{-1}$ is set to 1.00 in an FT-IR spectrum of the toner obtained by the ATR method with an infrared light-incidence angle of 45° using germanium as the ATR crystal, the intensity of the highest absorption peak in the range of 2843 $cm^{-1}$ to 2853 $cm^{-1}$ is called Ps.

Finally, when the intensity of the highest absorption peak in the range of 3022 $cm^{-1}$ to 3032 $cm^{-1}$ is set to 1.00 in an FT-IR spectrum of a toner sample obtained by the ATR method with an infrared light-incidence angle of 45° using germanium as the ATR crystal, the intensity of the highest absorption peak in the range of 2843 $cm^{-1}$ to 2853 $cm^{-1}$ is called Ph. The toner sample is obtained by heating the toner at 150° C. for 0.10 sec and then leaving it to cool to 25° C.

The toner of the invention then satisfies the following formulae (1) to (3):

$$Ps/Pd \leq 0.90 \quad \text{Formula (1)}$$

$$2.20 \leq Ph/Pd \quad \text{Formula (2)}$$

$$0.50 \leq Pd \leq 3.00 \quad \text{Formula (3)}$$

Pd and Ps above are measured using a toner that has not been heat treated at a high temperature at or above the temperature to which a toner is ordinarily exposed during transport.

The intensity of the highest absorption peak in the range of 2843 $cm^{-1}$ to 2853 $cm^{-1}$ when the intensity of the highest absorption peak in the range of 3022 $cm^{-1}$ to 3032 $cm^{-1}$ is set to 1.00 in an FT-IR spectrum of the toner obtained by the ATR method is taken as a value corresponding to the wax concentration in the measured region.

The highest absorption peak in the range of 2843 $cm^{-1}$ to 2853 $cm^{-1}$ is a peak attributable to —$CH_2$— stretching vibration. Since the waxes used in toners are normally either hydrocarbon compounds or compounds such as fatty acid esters with structures composed mainly of alkyl groups or alkylene groups, the peak intensity is relatively greater when the wax concentration is high in the measured region.

The highest absorption peak in the range of 3022 $cm^{-1}$ to 3032 $cm^{-1}$ derives from the C-H stretching vibration of an aromatic compound. The waxes used in toners either do not contain aromatic rings, or if present, these rings do not constitute a principal part of the structure. Consequently, in an FT-IR spectrum obtained by measurement of the toner, this peak is either not derived from the wax, or else the wax makes only a slight contribution to the peak, which is treated as a peak derived from other components in the toner. Consequently, if the spectrum has been standardized so that this peak is 1.00, it is possible to evaluate the wax concentration in the measured region using the highest absorption peak in the range of 2843 $cm^{-1}$ to 2853 $cm^{-1}$.

The peak intensity Pd represents the wax concentration from the toner surface to a depth of 1.0 μm in the direction of the toner center, or in other words the wax concentration of the surface region below the outermost surface of the toner. The peak intensity Ps represents the wax concentration from the toner surface to a depth of 0.3 μm in the direction of the toner center, or in other words the wax concentration near the outermost surface of the toner. The peak intensity Ph represents the wax concentration from the toner surface to a depth of 0.3 μm in the direction of the toner center in a toner sample that has been heated, or in other words the wax concentration near the outermost surface of a heated toner.

In the present invention, the peak intensity Pd is at least 0.50 and not more than 3.00, or preferably at least 1.00 and not more than 1.50. As discussed above, the peak intensity Pd signifies the wax concentration of the surface region below the outermost surface of the toner. If the Pd is at least 0.50, this means that a suitable amount of wax is present in the surface region of the toner. Consequently, wax that has moved from deeper in the interior of the toner during heating and fixing is less likely to be incorporated into the binder resin of this region, the movement of the wax from the toner interior towards the surface is less diminished, and wax exudation during fixing is not impeded. This effect is more apparent when the Pd is at least 1.00.

If the Pd is not more than 3.00, on the other hand, the mechanical strength of the toner surface layer is sufficiently high, and because the toner is thus resistant to deformation caused by external force, it is less likely to adhere to the members during the developing and transfer processes. Moreover, if the Pd is not more than 3.00 or preferably not more than 1.50, the amount of wax that does not move to near the outermost surface during fixing and heating is reduced. That is, because there is less excess wax that does not contribute to separation of the melted toner from the fixing member, the efficiency of movement of the wax to the outermost surface during heat is increased.

Ps/Pd represents the wax concentration near the outermost surface of the toner relative to the wax concentration in the surface region below the outermost surface, and is within the range of not more than 0.90. When the Pd above is at least 0.50 and not more than 3.00 and the Ps/Pd is not more than 0.90, this indicates a concentration gradient in which the wax concentration near the outermost surface is low while the wax concentration in the surface region below the outermost surface is high. Consequently, the wax in the surface region below the outermost surface and the wax deeper in the interior of the toner are both more likely to move to near the outermost surface during heat and fixing, increasing the efficiency of wax exudation. Moreover, if the Ps/Pd is not more than 0.90, because the concentration of wax eccentrically located near the outermost surface is relatively low, aggregation between toner particles due to melting of the wax near the outermost surface is less likely when the toner is exposed to a high-temperature environment for a long period of time during storage.

The Ps/Pd is preferably not more than 0.83. Moreover, the Ps/Pd is preferably as low as possible, and while there is no particular lower limit, it is preferably at least 0.30.

The method of controlling the Ps and Ps/Pd is not particularly limited, and besides adjusting the added amount of the wax, it is possible to include a step of exposing the toner particle or toner to carbon dioxide or a step of heat treating the toner particle or toner in an aqueous medium as discussed below for example.

Ph/Pd represents the efficiency of movement of the wax located in the surface region below the outermost surface to the outermost surface during heating, and is in the range of at least 2.20. As long as the value falls within this numerical range, the wax located in the surface region below the outermost surface and deeper in the interior of the toner moves efficiently to near the outermost surface during the fixing process. That is, within this numerical range it is possible to supply a sufficient amount of wax to the melted toner surface during heating and fixing while reducing the amount of excess wax, which can detract from heat-resistant storability and cause adhesion of the toner to the developing member. Image defects are thus less likely because the melted toner is easily separated from the fixing member.

The Ph/Pd is preferably at least 2.50. The Ph/Pd is preferably as high as possible, and while there is no particular upper limit, it is preferably not more than 7.50.

To control the value of the Ph/Pd within the aforementioned numerical range, besides controlling the Pd and Ps/Pd within the numerical ranges described above, it is desirable to configure the toner so as to increase the mobility of the wax in the direction of the toner surface during fixing and heating. The toner configuration is not particularly limited, but examples include a toner in which the phase separation between the wax and the binder resin is increased so that the wax is less likely to be incorporated into the binder resin, a toner with a core-shell structure in which the added amount of the shell material has been adjusted so that the shell layer does not impede exudation of the wax, and a toner having pathways for the wax to pass through the binder resin.

A specific method for manufacturing the toner of the invention is explained below step by step using the example of suspension polymerization, but the method of manufacturing the toner of the invention is not limited thereby.

(Step of Preparing Polymerizable Monomer Composition)

A polymerizable monomer for producing the binder resin is mixed with a wax, and as necessary a colorant and other additive to prepare a polymerizable monomer composition. When a colorant is included, the colorant may be dispersed in advance in a polymerizable monomer or organic solvent with a media stirring mill or the like before being mixed with the rest of the composition, or it may be dispersed after all of the composition has been mixed. A polar resin, pigment dispersant, charge control agent or the like may be mixed appropriately in the polymerizable monomer composition as necessary.

(Step of Dispersing Polymerizable Monomer Composition)

An aqueous medium containing a dispersion stabilizer is prepared and loaded into a stirring tank equipped with a stirring blade having strong shearing force, and the polymerizable monomer composition is then added thereto and dispersed by stirring to obtain a polymerizable monomer composition dispersion.

(Polymerization Step)

In the polymerization step, a polymerizable monomer contained in the polymerizable monomer composition dispersion obtained as described above is polymerized to obtain a toner particle dispersion. An ordinary temperature-adjustable stirring tank may be used in the polymerization step.

The polymerization temperature is ordinarily at least 40° C., or preferably at least 50° C. and not more than 90° C. The polymerization temperature may be the same from start to finish, but may also be raised during the second half of the polymerization process in order to obtain the desired molecular weight distribution. The stirring blade used in stirring may be any that can cause the resin particle dispersion to float without accumulating, and can maintain a uniform temperature within the tank.

(Volatile component removal step)

A volatile component removal step may be performed to remove unreacted polymerizable monomers and the like from the toner particle dispersion after completion of the polymerization step. The volatile component removal step is accomplished by heating and stirring the toner particle dispersion in a stirring tank equipped with a stirring means. The heating conditions during the volatile component removal step are adjusted appropriately depending on the vapor pressure of the polymerizable monomers and other components to be removed. The volatile component removal step may be performed at normal pressure or under reduced pressure.

(Solid-liquid Separation Step, Washing Step and Drying Step)

The toner particle dispersion may be treated with an acid or alkali with the aim of removing the dispersion stabilizer adhering to the toner particle surface. After the dispersion stabilizer has been removed from the toner particle, the toner particle is then separated from the aqueous medium by an ordinary solid-liquid separation method, but preferably water is added again to wash the toner particle and completely remove the acid or alkali and the dispersion stabilizer components dissolved in the acid or alkali. Once the washing step has been repeated as many times as necessary to thoroughly wash the toner particle, the toner particle can be obtained by further solid-liquid separation. The resulting toner particle can also be dried as necessary by a known drying means.

(External Addition Step)

An external additive may be added to the resulting toner particle to improve the fluidity, charging performance, anti-caking properties or the like. The external addition step may be accomplished for example by placing the external additive and the toner particle in a mixing apparatus equipped with a high-speed rotating blade, and thoroughly mixing them.

To obtain a toner by a dissolution suspension method, on the other hand, a binder resin and a wax are uniformly dissolved or dispersed in an organic solvent together with other materials including a polar resin, a colorant, a charge control agent and the like as necessary to prepare a resin solution. The resulting resin solution is dispersed in an aqueous medium and granulated, and the organic solvent contained in the granulated particle is removed to obtain a toner particle of the desired particle diameter. The resulting toner particle can then be subjected to a washing step, drying step and external addition step as in the suspension polymerization method described above.

The means of controlling the state of the wax is not particularly limited, but a step of exposing a toner particle or toner obtained as described above to carbon dioxide (hereunder called carbon dioxide treatment) is especially desirable. The treatment apparatus used in carbon dioxide treatment is not particularly limited as long as it can be adjusted to a specific pressure and temperature, but the treatment method is explained below based on the example of the treatment apparatus shown in FIG. 1.

The pressure holding tank Ta of the treatment apparatus shown in FIG. 1 is provided with a filter that prevents the treated toner particle or treated toner from escaping outside the tank Ta together with the carbon dioxide when the carbon dioxide is discharged outside the tank via back pressure valve V2, and also has a stirring mechanism for mixing purposes.

Carbon dioxide treatment is performed by first loading the untreated toner particle or untreated toner into the tank Ta (which has been adjusted to a specific temperature), and stirring. Valve V1 is then opened, and carbon dioxide in a compressed state is introduced into tank Ta by compression pump P from container B, which holds the carbon dioxide. Once a predetermined pressure has been reached, the pump is stopped, the valve V1 is closed, and the pressure is maintained for a predetermined amount of time with the inside of the tank Ta in a sealed state. Once the predetermined holding time has elapsed, the valve V2 is opened, the carbon dioxide is discharged outside the tank Ta, and the pressure inside the tank Ta is reduced to atmospheric pressure. This process of introducing the carbon dioxide, maintaining the pressure while bringing the untreated toner particle or untreated toner into contact with the carbon dioxide and then discharging the carbon dioxide after treatment may also be repeated two or more times.

The partial pressure and temperature of the carbon dioxide used in treatment may be adjusted appropriately in order to control the state of the wax inside the toner, and according to the composition of the toner. The partial pressure is preferably in the range of at least 1.0 MPa and not more than 3.5 MPa, and the temperature is preferably in the range of at least 10° C. and not more than 60° C. If the partial pressure and temperature of the carbon dioxide are within this range, the state of the wax can be controlled appropriately without causing aggregation among toner particles.

The carbon dioxide treatment time is preferably at least 5 minutes and not more than 180 minutes.

The inventors believe that the mechanism whereby this treatment step improves the exudation properties of the wax is as follows.

When the partial pressure of the carbon dioxide is within the aforementioned range, the carbon dioxide permeates the toner interior, temporarily melting the wax contained in the toner. The melted wax is diffused in the toner interior. When the carbon dioxide is then discharged, the melted wax re-solidifies in a dispersed state. If the partial pressure and temperature of the carbon dioxide are adjusted to within the aforementioned ranges during this process, the wax concentration near the surface layer can be easily controlled as specified in the present invention. Moreover, it is thought that causing the carbon dioxide to first permeate the toner interior and then discharging it causes routes for the passage of the melted wax to form in the toner interior, improving wax exudation during subsequent toner heating.

As a means of controlling the state of the wax, a toner particle or toner in which the wax has been dispersed in advance by any method may be dispersed in an aqueous medium, and then heat treated with stirring in this state. The wax acquires fluidity as a result of this heat treatment, causing it to move inside the toner particle or toner, but because the wax is hydrophobic, the wax concentration near the outermost surface of the toner can be reduced by heat treatment in an aqueous medium. To increase the mobility of the wax inside the toner particle or toner, any amount of any kind of organic solvent may be added, and the heat treatment temperature and time adjusted to obtain the desired state of the wax.

The heat treatment temperature is preferably at least 50° C. and not more than 120° C. The time is preferably at least 15 minutes and not more than 480 minutes.

Toluene, methyl ethyl ketone or the like is preferred as the organic solvent. The amount of the organic solvent is preferably at least 0.5 mass parts and not more than 30.0 mass parts per 100 mass parts of the toner particle or toner.

The compatibility and phase separation between the binder resin and the wax can be estimated by differential scanning calorimetric (DSC) measurement. When the temperature is raised at a predetermined speed from below the melting point of the wax in DSC measurement, an endothermic peak is observed at the melting point. When the same operation is performed using a toner as the sample, the wax that has phase separated from the binder resin exhibits an endotherm attributable to melting, while the wax that has compatibilized with the binder resin exhibits no endotherm. Consequently, the amount of phase separation of the wax in the toner can be estimated by comparing the endothermic quantity of the wax measured by itself with the endothermic quantity attributable to the wax when the toner is measured.

In the present invention, given 100.0% as the endothermic quantity per unit mass of the wax alone in DSC measurement, the endothermic quantity per unit mass attributable to the wax in DSC measurement of the toner is preferably at least 80.0% and not more than 100.0%. More preferably, it is at least 94.0% and not more than 100.0%. Within this range, there is not an excess of wax compatibilized with the binder resin, and heat-resistant storability is not diminished. Moreover, within this range the wax is unlikely to be incorporated into the binder resin during heating and fixing, which is desirable for increasing exudation of the wax. The endothermic quantity per unit mass attributable to the wax in DSC measurement of the toner can be controlled by means of the compositions and molecular weights of the binder resin and wax.

A known resin may be used as the binder resin in the toner of the invention.

Specific examples include vinyl resins, polyester resins, polyamide resin, furan resins, epoxy resins, xylene resins and silicone resins. These resins may be used individually or as a mixture.

Vinyl resins that can be used include homopolymers and copolymers of the following monomers: styrene monomers such as styrene, α-methylstyrene and divinylbenzene; unsaturated carboxylic acid esters such as methyl acrylate, butyl acrylate, methyl methacrylate, 2-hydroxyethyl methacrylate, t-butyl methacrylate and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic acid anhydride; and nitrile vinyl monomers such as acrylonitrile and the like.

Of these binder resins, a styrene acrylic resin using a styrene monomer and an acrylic monomer such as an unsaturated carboxylic acid ester and an unsaturated carboxylic acid is particularly desirable. With a styrene acrylic resin, the viscosity of the resin can be easily reduced when it is melted together with the wax during the fixing process. When the viscosity of the resin falls during the fixing process, the area of contact between the media and the toner is increased, and the lower viscosity produces an anchor effect between the resin and the media, resulting in good adhesion between the media and the toner. Due to such effects, the toner is unlikely to separate from the media even when the wax in the toner has strong exudation properties, and image defects are less likely to occur.

The ratio of the styrene monomer and acrylic monomer may be adjusted in light of the desired glass transition temperatures of the binder resin and toner particle.

A variety of polymerization initiators including peroxide polymerization initiators and azo polymerization initiators may be used in manufacturing the binder resin and toner particle. Examples of peroxide polymerization initiators that can be used include organic examples such as peroxyesters, peroxydicarbonate, dialkylperoxides, peroxyketals, ketone peroxides, hydroperoxides and diacyl peroxides. Inorganic examples include persulfate salts, hydrogen peroxide and the like.

Specific examples include peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate and t-butyl peroxy-2-ethylhexyl monocarbonate; diacyl peroxides such as benzoyl peroxide; peroxydicarbonates such as diisopropyl peroxydicarbonate; peroxyketals such as 1,1-di-t-hexyl peroxycyclohexane; dialkyl peroxides such as di-t-butyl peroxide; and t-butyl peroxyallyl monocarbonate and the like.

Azo polymerization initiators that can be used include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile and dimethyl-2,2'-azobis(2-methylpropionate).

Two or more of these polymerization initiators may be used together as necessary. In this case, the amount of the polymerization initiator is preferably at least 0.10 mass parts and not more than 20.0 mass parts per 100.0 mass parts of the polymerizable monomers.

A known wax may be used as the wax. Examples include the following compounds: aliphatic hydrocarbon waxes such as low-molecular-weight polyethylene, low-molecular-weight polypropylene, microcrystalline wax, paraffin wax and Fischer-Tropsch wax; oxides of aliphatic hydrocarbon waxes, such as polyethylene oxide wax, and block copolymers of these; waxes composed primarily of fatty acid esters, such as sasol wax, ester wax and montanic acid ester wax; partially or wholly deoxidized aliphatic ester waxes, such as deoxidized carnauba wax; waxes obtained by grafting vinyl monomers such as styrene or acrylic acid onto aliphatic hydrocarbon waxes; partial esterification products of fatty acids and polyvalent alcohols, such as behenic acid monoglyceride; and methyl ester compounds with hydroxyl groups obtained by hydrogenation or the like of vegetable oils and fats.

Of these waxes, a hydrocarbon wax is especially desirable. A hydrocarbon wax is desirable because it is effective for assisting separation of the toner from the fixing member when it is exuded from the toner in the fixing process, and a greater improvement effect on low-temperature fixability is obtained when wax exudation efficiency is increased as in the present invention. A hydrocarbon wax also helps to improve exudation because it has a high degree of phase separability with the binder resin.

The content of the wax is preferably at least 2.0 mass parts and not more than 30.0 mass parts, or more preferably at least 3.0 mass parts and not more than 15.0 mass parts per 100.0 mass parts of the binder resin. If the wax content is at least 2.0 mass parts, the toner as a whole is more likely to deform when the toner is heated and pressurized during the fixing process, which is desirable for affixing the toner to the media. A content of not more than 30.0 mass parts is desirable for inhibiting adhesion of the toner to the developing member and the like even in a toner with good wax exudation properties, and for preventing separation between the toner and the media due to excessive wax exudation.

The melting point of the wax used in the present invention is preferably at least 60° C. and not more than 110° C., or more preferably at least 70° C. and not more than 80° C. Using a wax with such thermal characteristics, the resulting toner has good fixability, the release effect of the wax is efficiently realized, and a sufficient fixing area is secured.

Moreover, in the present invention wax domains with an aspect ratio of at least 5 are preferably present in a cross-section of the toner observed under a transmission electron microscope. When the wax concentration of the surface region is high and the wax has domains with a high aspect ratio, and the high-aspect-ratio wax is exuded on the surface of the melted toner, gaps are formed that provide exudation pathways for the wax in the toner interior, further enhancing the wax exudation effect.

From the standpoint of low-temperature fixability and heat-resistant storability, the number of these domains is preferably at least 5 and not more than 150, or more preferably at least 20 and not more than 80. The aspect ratio of a wax domain is a value obtained by taking the rectangle with the smallest areas out of the rectangles contacting the outer edge of the wax domain, and dividing the long side by the short side. The number of wax domains with an aspect ratio of at least 5 can be controlled by means of the temperature during the carbon dioxide treatment or heat treatment, the selection of binder resin and wax, and the content of the wax.

A polar resin may be included in the toner particle. In particular, when a polar resin is included and the process of manufacturing the toner particle involves granulation in an aqueous medium or heat treatment of the toner particle dispersed in an aqueous medium, the polar resin becomes eccentrically distributed on the surface of the resulting toner particle because it is likely to migrate to near the boundary between the aqueous medium and the other components due to differences in affinity for water. This gives the toner particle a core-shell structure.

By giving the toner particle a core-shell structure, it is possible to reduce exposure of the wax on the toner surface, which is desirable for reasons of heat-resistant storability and developability, and for preventing adhesion to the members. That is, in a preferred embodiment of the present invention the toner particle has a core-shell structure, wherein the core contains a binder resin and a wax and the shell contains a polar resin.

The polar resin is preferably a saturated or unsaturated polyester resin. When a saturated or unsaturated polyester resin is used as the polar resin, the lubricating properties of the resin itself are anticipated when it becomes eccentrically distributed to form a shell on the surface of the toner particle.

The acid value of the polar resin is preferably at least 1.0 mg KOH/g and not more than 5.0 mg KOH/g, or more preferably at least 1.5 mg KOH/g and not more than 4.5 mg KOH/g.

If the acid value is at least 1.0 mg KOH/g, good dispersion stability is obtained in the case of granulation in an aqueous medium or heat treatment of the toner particle dispersed in an aqueous medium. Coarse toner particles are therefore unlikely to occur, and there is little reduction in low-temperature fixability. Irregularities in the shell thickness are also unlikely, and there is little loss of heat-resistant storability even when a highly exudative wax is present as in the present invention. If the acid value is not more than 5.0 mg KOH/g, moreover, good low-temperature fixability is obtained because it is easy to promote wax exudation during fixing.

The polyester resin may be one obtained by condensation polymerization of the acid component monomers and alcohol component monomers given below. Examples of acid component monomers include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid and trimellitic acid.

Examples of alcohol component monomers include alkylene glycols and polyalkylene glycols such as ethylene glycol, diethylene glycol, triethylene glycol, 1,2-propanediol, 1,3-propanediol, 1,4-butanediol, neopentyl glycol and 1,4-bis(hydroxymethyl)cyclohexane, and bisphenol A, hydrogenated bisphenols, bisphenol A ethylene oxide adduct, bisphenol A propylene oxide adduct, glycerin, trimethylol propane and pentaerythritol.

The content of the polar resin is preferably at least 0.2 mass parts and not more than 20.0 mass parts, or more preferably at least 1.0 mass part and not more than 6.0 mass parts per 100.0 mass parts of the binder resin. Within this range, exposure of the wax on the toner surface is suppressed, and heat-resistant storability is not reduced. Also, exudation of the wax during the fixing process is not inhibited.

The toner of the invention may also contain a colorant. A known colorant such as various conventionally known dyes and pigments may be used as the colorant.

A carbon black, a magnetic material, or a black colorant obtained by blending the yellow, magenta and cyan colorants described below may be used as a black colorant.

A monoazo compound, disazo compound, condensed azo compound, isoindolinone compound, anthraquinone compound, azo metal complex methine compound or allylamide compound for example may be used as a yellow colorant. Specific examples include C.I. Pigment Yellow 74, 93, 95, 109, 111, 128, 155, 174, 180 and 185.

A monoazo compound, condensed azo compound, diketopyrrolopyrrole compound, anthraquinone compound, quinacridone compound, basic dye lake compound, naphthole compound, benzimidazolone compound, thioindigo compound or perylene compound may be used as a magenta colorant. Specific examples include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254 and 269 and C.I. Pigment Violet 19.

A copper phthalocyanine compound or derivative thereof, an anthraquinone compound or a basic dye lake compound for example may be used as a cyan compound. Specific examples include C.I. Pigment Blue 1, 7, 15, 15:1, 15:2, 15:3, 15:4, 60, 62 and 66.

When the toner of the invention is used as a magnetic toner, a magnetic material may be included in the toner particle. In this case, the magnetic material may also serve as a colorant. Examples of such magnetic materials in the present invention include iron oxides such as magnetite, hematite and ferrite, and metals such as iron, cobalt and nickel. Other examples include alloys of these metals with other metals such as aluminum, cobalt, copper, lead, magnesium, tin, zinc, antimony, beryllium, bismuth, cadmium, calcium, manganese, selenium, titanium, tungsten and vanadium, and mixtures of these.

The colorant may be selected based on considerations of hue angle, chroma, lightness, light resistance, OHP transparency and dispersibility in the toner particle. These colorants may be used individually, or as a mixture, or in a solid solution. The colorant is preferably used in the amount of at least 1.0 mass part and not more than 20.0 mass parts per 100.0 mass parts of the binder resin.

A charge control agent may also be included in the toner of the invention to improve the toner characteristics. Specific examples of negative charging charge control agents include metal compounds of aromatic carboxylic acids such as salicylic acid, alkylsalicylic acid, dialkylsalicylic acid, naphthoic acid and dicarboxylic acid; polymers or copolymers having sulfonic acid groups, sulfonate groups or sulfonic acid ester groups; metal salts or metal complexes of azo dyes or azo pigments; and boron compounds, silicon compounds, calixarenes and the like.

Examples of positive charging charge control agents include quaternary ammonium salts and polymeric compounds having quaternary ammonium salts in the side chains, and guanidine compounds, nigrosine compounds, imidazole compounds and the like. Examples of polymers or copolymers having sulfonic acid groups, sulfonate groups or sulfonic acid ester groups include homopolymers of vinyl monomers containing sulfonic acid groups, such as styrenesulfonic acid, 2-acrylamido-2-methylpropanesulfonic acid, 2-methacrylamido-2-methylpropanesulfonic acid, vinylsulfonic acid and methacrylsulfonic acid, as well as copolymers of such sulfonic acid group-containing vinyl monomers with vinyl monomers such as the acrylic monomers and styrene monomers described with reference to the binder resin.

The charge control agent is preferably used in the amount of at least 0.1 mass parts and not more than 10.0 mass parts per 100.0 mass parts of the binder resin.

An external additive is preferably added to the toner of the invention to improve image quality. An inorganic fine particle such as a silicic acid fine particle, titanium oxide, aluminum oxide or the like may be used favorably as the external additive. These inorganic fine particles are preferably treated hydrophobically with a hydrophobic agent such as a silane coupling agent or silicone oil or a mixture of these. The external additive is preferably used in the amount of at least 0.1 mass parts and not more than 5.0 mass parts, or more preferably at least 0.1 mass parts and not more than 3.0 mass parts per 100.0 mass parts of the toner particle.

A known surfactant, organic dispersant or inorganic dispersant may be used as the dispersion stabilizer added to the aqueous medium. Of these, an inorganic dispersant can be used by preference because it is unlikely to be destabilized by the polymerization temperature or the passage of time, and because it is easy to wash and unlikely to adversely affect the toner. Examples of inorganic dispersants include polyvalent metal salts of phosphoric acid, such as calcium phosphate, magnesium phosphate, aluminum phosphate and zinc phosphate; carboxylic acid salts such as calcium carbonate and magnesium carbonate; inorganic salts such as calcium metasilicate, calcium sulfate and barium sulfate; and calcium hydroxide, magnesium hydroxide, aluminum hydroxide, and inorganic oxides such as silica, bentonite and alumina. After completion of polymerization, these inorganic dispersants may be removed by adding an acid or alkali to dissolve the dispersant.

The organic solvent used in the resin solution in the dissolution suspension method is not particularly limited as long as it is compatible with the raw materials of the toner particle including the binder resin and wax, but one with a certain vapor pressure even below the boiling point of water is preferably from the standpoint of solvent removal. For example, toluene, xylene, ethyl acetate, butyl acetate, methyl ethyl ketone, methyl isobutyl ketone or the like may be used.

The methods for measuring the various physical properties of the toner and materials and the methods for preparing the measurement samples are explained next.

(Toner Pellet Molding)

A molded pellet of the toner is used for measuring the FT-IR spectrum of the toner by ATR method. As discussed above, the toner used for determining Pd and Ps a toner that has not been heat treated at a high temperature at or above the normal temperature to which the toner is exposed during transport.

100 mg of toner is placed in a mold (height 16.0 mm) capable of pressure molding a cylindrical pellet of which both bottom faces are perfectly circular flat surfaces 8.0 mm in diameter. A load of 24 kN is then applied in the normal direction of the cylinder bottom, and maintained for 60 seconds to mold a toner pellet.

(Calculating Pd, Ps and Ph)

A Universal ATR Sampling Accessory mounted on a Fourier transform infrared spectroscopic analyzer (Frontier; PerkinElmer Inc.) is used to measure the FT-IR spectrum of the toner by ATR method. PerkinElmer Spectrum ver. 10.4.3 (PerkinElmer Inc.) is used as the measurement and analysis software. The incidence angle of the infrared light is set to 450.

The specific conditions are shown below.

(Method for Calculating Peak Intensity Pd)

A Universal ATR top plate with a diamond ATR crystal (single reflection diamond/KRS5; two-layer structure of diamond and KRS5 crystals, with the diamond crystal in contact with the sample) is mounted.

Background measurement is performed with the scan type set to "background" and the vertical axis unit to "energy".

The scan type is then set to "sample", and the vertical axis unit to "A".

The toner pellet is set on the ATR crystal with its bottom surface in contact with the crystal, the two are brought into close contact by the pressure arm, and measurement is performed.

Bidirectional baseline correction is selected, two parts out of the part lacking peaks in the range of 3100 $cm^{-1}$ to 3500 $cm^{-1}$ in the resulting FT-IR spectrum are selected as base points, two points in the part lacking peaks in the range of 2000 $cm^{-1}$ to 2700 $cm^{-1}$ are also selected as base points, and base line correction is performed.

The spectrum is standardized so that the intensity of the highest absorption peak in the range of 3022 $cm^{-1}$ to 3032 $cm^{-1}$ in the corrected spectrum is 1.00.

The intensity of the highest absorption peak in the range of 2843 $cm^{-1}$ to 2853 $cm^{-1}$ in the standardized spectrum is given as Pd.

(Method for Calculating Peak Intensity Ps)

The peak intensity Ps is calculated in the same way as the peak intensity Pd except that a germanium ATR crystal (single reflection Ge/Ge) is substituted for the ATR crystal in the Universal ATR top plate.

(Method for Calculating Peak Intensity pH)

The peak intensity Ph is calculated in the same way as the peak intensity Ps except that a pellet that has been heated for 0.10 seconds by the method described below and then left to cool to 25° C. is used as the toner pellet, which is then mounted with its heated surface in contact with the ATR crystal.

(Toner Heating)

A tacking tester (TAC-1000, Rhesca Co., Ltd.) is used to heat the toner. A toner pellet formed by the methods described above is fixed on the sample stand in such a way that it does not follow the rising operation of the probe. A heating probe with a smooth bottom face is then brought into contact with the upper smooth face of the pellet at a fixed rate of speed. Once the pressing pressure has reached the set value with the toner pellet face and probe face in contact with each other, the pressure is maintained to heat the sample. The probe is then raised at a fixed rate of speed to separate the toner pellet and the probe. The heating method described here is performed under the following conditions.

Probe shape: Cylinder with a circle 5.0 mm in diameter as the surface contacting the sample Probe material: Stainless steel Probe temperature: 150° C.

Contact time: 0.10 seconds

Pressing pressure: 1.0 MPa

Probe descent rate: 0.5 mm/second

Probe rising rate: 1.5 mm/second (Number of Wax Domains of Aspect Ratio of 5 or More in Toner Cross-section)

The number of wax domains with an aspect ratio of at least 5 is calculated by the following methods in each of the resulting toners.

The toner is embedded in a visible light-curable embedding resin (D-800; Nisshin EM Co., Ltd.), cut to a thickness of 60 nm with an ultrasound Ultramicrotome (EM5; Leica Microsystems GmbH), and Ru stained with a vacuum staining apparatus (Filgen, Inc.). It is then observed at an acceleration voltage of 120 kV with a transmission electron microscope (H7500; Hitachi, Ltd.). Particles within ±2.0 μm of the weight-average particle diameter are selected and photographed as the toner cross-sections for observation.

5 toners are selected from the photographed images, the number of wax domains with an aspect ratio of 5 or more is counted in each cross-section, and the median value of the 5 toners is given as the number of domains.

(Measuring Endothermic Quantity of Wax)

The endothermic quantity of the wax in the present invention is measured under the following conditions using a DSC Q2000 (TA Instruments).

Ramp rate: 10° C./minute

Measurement start temperature: 20° C.

Measurement end temperature: 180° C.

The melting points of indium and zinc are used for temperature correction of the device detection part, and the heat of fusion of indium is used for correction of the calorific value. Specifically, 2.0 mg of the toner sample is weight precisely, placed in an aluminum pan, and measured once. An empty aluminum pan is used for reference.

A DSC curve is then drawn with the analysis software (Universal Analysis 2000 Ver. 4.1D, TA Instruments), and the area of the endothermic peak at the melting point of the wax is calculated.

When the wax is measured by itself, the area calculated by the methods described above is given as the endothermic quantity per unit mass. The endothermic quantity per unit mass attributable to the wax in the toner is determined by estimating the ratio of the wax contained in the toner as a percentage of the total mass of the toner based on the added amounts of the raw materials in the toner manufacturing process, and then multiplying this ratio by the previous area obtained by measuring the toner sample.

(Measuring Acid Value of Polar Resin)

The acid value of the polar resin is measured in accordance with JIS K1557-1970. The specific measurement methods are as follows. 2 g of pulverized sample is weighed precisely (W (g)), and placed in a 200 mL triangular flask. 100 mL of a mixed toluene/ethanol (2:1) solution is added, and the sample is dissolved for 5 hours. A phenolphthalein solution is added as an indicator. This solution is then titrated with a burette using a 0.1 mol/L KOH alcohol solution. The amount of the KOH solution here is given as S (mL). A blank test is performed, and the amount of the KOH solution in the blank test is given as B (mL). The acid value is then calculated by the following formula. "f" in the formula is the factor of the KOH solution.

$$\text{Acid value (mg KOH/g)}=\{(S-B)\times f\times 5.61\}/W$$

EXAMPLES

The present invention is explained in detail using the following examples. However, these examples do not limit the present invention. The method for manufacturing the toner is explained below. Unless otherwise specified, parts and percentages in the manufacturing examples are all based on mass.

(Toner Manufacturing Examples)

(Toner 1)

(Preparation of Toner Particle)

A toner was manufactured by the following methods. A polymerizable monomer mixture consisting of the following was prepared.

| | |
|---|---|
| Styrene | 78.0 parts |
| n-butyl acrylate | 22.0 parts |
| Copper phthalocyanine pigment (C.I. Pigment Blue 15:3) | 6.0 parts |
| Aluminum salicylate compound (Bontron E-88, Orient Chemical Industries Co., Ltd.) | 0.7 parts |
| Polar resin 1 (polymer of terephthalic acid, trimellitic acid, bisphenol A propylene oxide 1.5 mol adduct, ethylene glycol and isosorbide, acid value 2.5 mg KOH/g, glass transition temperature (Tg) = 80° C., weight-average molecular weight (Mw) = 15,000) | 4.0 parts |
| Hydrocarbon wax (melting point 77° C.) | 10.0 parts |
| 15 mm ceramic beads were added to this, and the mixture was dispersed for 2 hours with a wet attritor (Nippon Coke & Engineering Co., Ltd.) to obtain a polymerizable monomer composition. | |

Meanwhile, 6.3 parts of sodium phosphate ($Na_3PO_4$) were added to 414.0 parts of ion-exchange water, and heated to 60° C. while being stirred with a Clearmix (M Technique Co., Ltd.). A calcium chloride aqueous solution consisting of 3.6 parts of calcium chloride ($CaCl_2$) dissolved in 25.5 parts of ion-exchange water was added, and stirring was continued to obtain an aqueous medium containing calcium phosphate as a dispersion stabilizer.

10.0 parts of t-butyl peroxypivalate as a polymerization initiator were added to this polymerizable monomer composition, which was then added to the previous aqueous dispersion medium. Granulation was performed for 10 minutes with the Clearmix with the rotational speed maintained at 15,000/minute. This was then polymerized for 8 hours with stirring with the temperature maintained at 70° C. in a stirring tank equipped with an ordinary stirrer, to obtain a toner particle dispersion.

The toner particle dispersion was cooled, hydrochloric acid was added to reduce the pH to 1.4 or less and dissolve the dispersion stabilizer, and the dispersion was filtered, washed and dried to obtain a toner particle A.

(Carbon Dioxide Treatment Step)

The resulting toner particle A was subjected to carbon dioxide treatment. 20.0 g of the toner particle A was placed in the tank Ta of the apparatus shown in FIG. 1, the internal temperature of the tank Ta was adjusted to 25° C., and the particle was stirred at 150 rpm as valve V1 was opened and carbon dioxide (purity 99.99%) was introduced into tank Ta by pump P from canister B. The valve V1 and valve V2 were regulated to raise the pressure until the pressure inside the tank Ta reached 2.7 MPa. Pump P was then stopped, valve V1 was closed, valve V2 was regulated so that the interior of the tank was in a sealed state, and the pressure was maintained for 30 minutes. Valve V2 was then regulated to depressurize the interior of tank Ta to atmospheric pressure. Stirring was then stopped, and tank Ta was opened to obtain a carbon dioxide-treated toner particle A'.

(External Addition Step)

0.3 parts of hydrophobic titanium oxide were added to 100.0 parts of the resulting carbon dioxide-treated toner particle A', and mixed with a FM mixer (Nippon Coke & Engineering Co., Ltd.), after which 1.5 parts of hydrophobic silica were added and mixed with the FM mixer to obtain a toner 1 having an external additive. The toner particle in the toner 1 is a toner particle having a core-shell structure comprising a core containing a binder resin and a wax and a shell containing a polar resin.

(Toner 2)

Toner 2 was obtained as in the manufacturing example of toner 1 except that 80.5 parts of styrene, 4.9 parts of n-stearyl acrylate and 14.6 parts of n-butyl acrylate were used instead of 78.0 parts of styrene and 22.0 parts of n-butyl acrylate, and the pressure was raised until the pressure inside the tank Ta was 1.2 MPa in the carbon dioxide treatment step. The toner particle in toner 2 has a core-shell structure comprising a core containing a binder resin and a wax and a shell containing a polar resin.

(Toner 3)

Toner 3 was obtained as in the manufacturing example of toner 1 except that 81.7 parts of styrene, 7.3 parts of n-stearyl acrylate and 11.0 parts of n-butyl acrylate were used instead of 78.0 parts of styrene and 22.0 parts of n-butyl acrylate, and the pressure was raised until the pressure inside the tank Ta was 1.2 MPa in the carbon dioxide treatment step. The toner particle in toner 3 has a core-shell structure comprising a core containing a binder resin and a wax and a shell containing a polar resin.

(Toner 4)

Toner 4 was obtained as in the manufacturing example of toner 1 except that the internal temperature of the tank Ta was adjusted to 10° C. in the carbon dioxide treatment step. The toner particle in toner 4 has a core-shell structure comprising a core containing a binder resin and a wax and a shell containing a polar resin.

(Toner 5)

Toner 5 was obtained as in the manufacturing example of toner 1 except that the internal temperature of the tank Ta was adjusted to 60° C. in the carbon dioxide treatment step. The toner particle in toner 5 has a core-shell structure comprising a core containing a binder resin and a wax and a shell containing a polar resin.

(Toner 6)

Toner 6 was obtained as in the manufacturing example of toner 1 except that the internal temperature of the tank Ta was adjusted to 0° C. in the carbon dioxide treatment step. The toner particle in toner 6 has a core-shell structure comprising a core containing a binder resin and a wax and a shell containing a polar resin.

(Toner 7)

Toner 7 was obtained as the manufacturing example of toner 1 except that the internal temperature of the tank Ta was adjusted to 70° C. in the carbon dioxide treatment step. The toner particle in toner 7 has a core-shell structure comprising a core containing a binder resin and a wax and a shell containing a polar resin.

(Toner 8)

Toner 8 was obtained as in the manufacturing example of toner 1 except that 10.0 parts of behenyl behenate (melting point 73° C.) were used instead of 10.0 parts of hydrocarbon wax (melting point 77° C.). The toner particle in toner 8 has a core-shell structure comprising a core containing a binder resin and a wax and a shell containing a polar resin.

(Toner 9)

A toner was manufactured by the following methods.

(Preparation of Polyester Resin A)

The following materials were placed in a reaction tank equipped with a nitrogen introduction pipe, a dewatering pipe, a stirrer and a thermocouple.

| | |
|---|---|
| Terephthalic acid | 100.0 parts |
| Ethylene glycol | 44.0 parts |
| Propylene glycol | 3.0 parts |
| Neopentyl glycol | 49.0 parts |
| Dibutyltin oxide | 3.0 parts |

Next, the temperature was rapidly raised to 180° C. at normal pressure in a nitrogen atmosphere, and water was distilled off as the mixture was heated from 180° C. to 210° C. at a rate of 10° C./hour to perform polycondensation. After the temperature had reached 210° C., the pressure inside the reaction tank was reduced to 5 kPa or less, and polycondensation was performed under conditions of 210° C., 5 kPa or less to obtain a polyester resin A.

(Preparation of Toner Particle B)

| | |
|---|---|
| Polyester resin A | 100.0 parts |
| Polar resin 1 | 4.0 parts |
| Copper phthalocyanine pigment (C.I. Pigment Blue 15:3). | 5.0 parts |
| Hydrocarbon wax (melting point 77° C.) | 10.0 parts |
| Ethyl acetate | 100.0 parts |

These materials were pre-mixed in a container, and dispersed for 4 hours in a bead mill with the temperature maintained at 20° C. or less to prepare a toner composition mixture.

78.0 parts of a 0.1 mol/L $Na_3PO_4$ aqueous solution were added to 240.0 parts of ion-exchange water, heated to 60° C., and stirred at a rotational speed of 14,000 rpm with a Clearmix. 12.0 parts of a 1.0 mol/L-$CaCl_2$ aqueous solution were added thereto to obtain a dispersion medium (aqueous medium) containing $Ca_3(PO_4)_2$. 1.0 part of carboxymethyl cellulose was then added, and the mixture was stirred for 10 minutes.

The temperature of the dispersion medium was adjusted to 30° C., the mixture was stirred as 180.0 parts of the previous toner composition mixture adjusted to a temperature of 30° C. were added, and stirring was continued for 1 minute and then stopped to obtain a toner composition dispersion suspension. The resulting toner composition dispersion suspension was stirred and the temperature was maintained at a fixed 40° C. as the gas phase on the surface of the suspension was forcibly renewed with an exhaust device, and the mixture was maintained in the same state for 17 hours to remove the solvent. This was cooled to room temperature, hydrochloric acid was added to dissolve the $Ca_3(PO_4)_2$, and the mixture was filtered, washed and dried to obtain a toner particle B.

(Carbon Dioxide Treatment Step)

The toner particle B was treated with carbon dioxide as in the manufacturing example of toner 1 to obtain a carbon dioxide-treated toner particle B'.

(External Addition Step)

External additives were added to the carbon dioxide-treated toner particle B' as in the manufacturing example of toner 1 to obtain a toner 9. The toner particle in toner 9 has a core-shell structure comprising a core containing a binder resin and a wax and a shell containing a polar resin.

(Toner 10)

Toner 10 was obtained as in the manufacturing example of toner 1 except that 3.0 parts of hydrocarbon wax (melting point 77° C.) were used instead of 10.0 parts of hydrocarbon wax (melting point 77° C.). The toner particle in toner 10 has a core-shell structure comprising a core containing a binder resin and a wax and a shell containing a polar resin.

(Toner 11)

Toner 11 was obtained as in the manufacturing example of toner 1 except that 30.0 parts of hydrocarbon wax (melting point 77° C.) were used instead of 10.0 parts of hydrocarbon wax (melting point 77° C.). The toner particle in toner 11 has a core-shell structure comprising a core containing a binder resin and a wax and a shell containing a polar resin.

(Toner 12)

Toner 12 was obtained as in the manufacturing example of toner 1 except that 1.5 parts of hydrocarbon wax (melting point 77° C.) were used instead of 10.0 parts of hydrocarbon wax (melting point 77° C.), and the pressure inside the tank Ta was raised to 1.2 MPa in the carbon dioxide treatment step. The toner particle in toner 12 has a core-shell structure comprising a core containing a binder resin and a wax and a shell containing a polar resin.

(Toner 13)

Toner 13 was obtained as in the manufacturing example of toner 1 except that 33.0 parts of hydrocarbon wax (melting point 77° C.) were used instead of 10.0 parts of hydrocarbon wax (melting point 77° C.), and the pressure inside the tank Ta was raised to 3.3 MPa in the carbon dioxide treatment step. The toner particle in toner 13 has a core-shell structure comprising a core containing a binder resin and a wax and a shell containing a polar resin.

(Toner 14)

Toner 14 was obtained as in the manufacturing example of toner 1 except that the amount of the polar resin 1 was changed from 4.0 parts to 6.0 parts, and the pressure inside the tank Ta was raised to 3.0 MPa in the carbon dioxide treatment step. The toner particle in toner 14 has a core-shell structure comprising a core containing a binder resin and a wax and a shell containing a polar resin.

(Toner 15)

Toner 15 was obtained as in the manufacturing example of toner 1 except that 2.0 parts of hydrocarbon wax (melting point 77° C.) were used instead of 10.0 parts of hydrocarbon wax (melting point 77° C.), and the amount of the polar resin 1 was changed from 4.0 parts to 6.0 parts. The toner particle in toner 15 has a core-shell structure comprising a core containing a binder resin and a wax and a shell containing a polar resin.

(Toner 16)

Toner 16 was obtained as in the manufacturing example of toner 1 except that 30.0 parts of hydrocarbon wax (melting point 77° C.) were used instead of 10.0 parts of hydrocarbon wax (melting point 77° C.), the amount of the polar resin 1 was changed from 4.0 parts to 1.0 part, and the pressure inside the tank Ta was raised to 3.3 MPa in the carbon dioxide treatment step. The toner particle in toner 16 has a core-shell structure comprising a core containing a binder resin and a wax and a shell containing a polar resin.

(Toner 17)

A pulverized toner was manufactured by the following methods.

The following materials were placed in a reaction vessel equipped with a reflux condenser pipe, a stirrer and a nitrogen introduction pipe in a nitrogen atmosphere.

| | |
|---|---|
| Styrene | 78.0 parts |
| n-butyl acrylate | 22.0 parts |
| Toluene | 100 parts |
| di-t-butyl peroxide (PBD) | 7.2 parts |

The contents of the vessel were stirred at a rate of 200 times a minute, heated to 110° C., and then stirred for 10 hours. This was then heated to 140° C. and polymerized for 6 hours. The solvent was distilled off to obtain a styrene acrylic resin A.

| | |
|---|---|
| Styrene acrylic resin A | 100.0 parts |
| Carbon black (Printex 35; Orion Engineered Carbons S.A.) | 7.0 parts |
| Polar resin 1 | 4.0 parts |
| Hydrocarbon wax (melting point 77° C.) | 10.0 parts |

These materials were mixed in an FM mixer (Nippon Coke & Engineering Co., Ltd.) and melt kneaded with a twin-screw kneading extruder at 125° C., and the kneaded product was gradually cooled to room temperature, coarsely pulverized with a cutter mill, and then pulverized with a fine pulverizer using a jet stream and air classified to prepare a toner particle C.

Meanwhile, 6.3 parts of sodium phosphate ($Na_3PO_4$) were added to 414.0 parts of ion-exchange water, and heated to 60° C. while being stirred with a Clearmix. A calcium chloride aqueous solution consisting of 3.6 parts of calcium chloride ($CaCl_2$) dissolved in 25.5 parts of ion-exchange water was then added, and stirring was continued to prepare an aqueous medium containing calcium phosphate as a dispersion stabilizer. The toner particle C was added with the rotational speed of the Clearmix maintained at 15,000/minute, to prepare a toner particle dispersion.

The toner particle dispersion was then stirred in a stirring tank with an ordinary stirrer with the temperature maintained at 60° C. as 5.0 parts of toluene were added. After 1 hour the temperature was raised to 100° C., and stirring was continued for 5 hours.

The toner particle dispersion was cooled, hydrochloric acid was added to lower the pH to 1.4 or less and dissolve the dispersion stabilizer, and the mixture was filtered, washed and dried to obtain a toner particle C'. The resulting toner particle C' was subjected to an external addition step as in the manufacturing example of toner 1 to obtain a toner 17 having external additives.

(Toner 18)

Toner 18 was obtained as in the manufacturing example of toner 1 except that polar resin 2 (polymer of terephthalic acid, trimellitic acid, bisphenol A propylene oxide 1.5 mol adduct, ethylene glycol and isosorbide, acid value 0.8 mg KOH/g, glass transition temperature (Tg)=78° C., weight-average molecular weight (Mw)=14,500) was used instead of the polar resin 1.

(Toner 19)

Toner 19 was obtained as in the manufacturing example of toner 1 except that polar resin 3 (polymer of terephthalic acid, trimellitic acid, bisphenol A propylene oxide 1.5 mol adduct, ethylene glycol and isosorbide, acid value 5.2 mg KOH/g, glass transition temperature (Tg)=77° C., weight-average molecular weight (Mw)=15,000) was used instead of the polar resin 1.

(Toner 20)

Toner 20 was obtained as in the manufacturing example of toner 1 except that 1.5 parts of hydrocarbon wax (melting point 77° C.) were used instead of 10.0 parts of hydrocarbon wax (melting point 77° C.), and the pressure inside the tank Ta was raised to 0.8 MPa in the carbon dioxide treatment step.

(Toner 21)

Toner 21 was obtained as in the manufacturing example of toner 1 except that 3.0 parts of hydrocarbon wax (melting point 77° C.) were used instead of 10.0 parts of hydrocarbon wax (melting point 77° C.), and the pressure inside the tank Ta was raised to 3.7 MPa in the carbon dioxide treatment step.

(Toner 22)

Toner 22 was obtained as in the manufacturing example of toner 1 except that 2.0 parts of hydrocarbon wax (melting point 77° C.) were used instead of 10.0 parts of hydrocarbon wax (melting point 77° C.), the amount of the polar resin 1 was changed from 4.0 parts to 10.0 parts, and the internal temperature of the tank Ta was adjusted to 8° C. in the carbon dioxide treatment step.

(Toner 23)

Toner 23 was obtained as in the manufacturing example of toner 1 except that 30.0 parts of hydrocarbon wax (melting point 77° C.) were used instead of 10.0 parts of hydrocarbon wax (melting point 77° C.), the amount of the polar resin 1 was changed from 4.0 parts to 0.5 parts, and the internal temperature of the tank Ta was adjusted to 8° C. while the pressure inside the tank Ta was raised to 3.3 MPa in the carbon dioxide treatment step.

The physical properties of the resulting toners are shown in Table 1.

TABLE 1

| Toner | P d | P s | P h | Ps/Pd | Ph/Pd | Wax domains of aspect ratio of 5 or more | Endothermic quantity of wax (in toner/wax alone) |
|---|---|---|---|---|---|---|---|
| Toner 1 | 1.29 | 1.06 | 3.45 | 0.82 | 2.67 | 56 | 97.8% |
| Toner 2 | 1.25 | 1.08 | 3.25 | 0.86 | 2.60 | 23 | 80.9% |
| Toner 3 | 1.23 | 1.10 | 3.18 | 0.89 | 2.59 | 32 | 76.4% |
| Toner 4 | 1.29 | 1.05 | 2.91 | 0.81 | 2.26 | 5 | 94.7% |
| Toner 5 | 1.31 | 1.08 | 3.49 | 0.82 | 2.66 | 146 | 98.2% |
| Toner 6 | 1.30 | 1.07 | 2.87 | 0.82 | 2.21 | 2 | 90.2% |
| Toner 7 | 1.30 | 1.09 | 3.43 | 0.84 | 2.64 | 168 | 99.1% |
| Toner 8 | 1.06 | 0.82 | 2.44 | 0.77 | 2.30 | 141 | 81.3% |
| Toner 9 | 1.03 | 0.83 | 2.71 | 0.81 | 2.63 | 42 | 99.8% |
| Toner 10 | 1.29 | 1.06 | 3.02 | 0.82 | 2.34 | 50 | 97.6% |
| Toner 11 | 1.36 | 1.09 | 3.51 | 0.80 | 2.58 | 62 | 97.5% |
| Toner 12 | 1.15 | 1.01 | 2.63 | 0.88 | 2.29 | 50 | 96.0% |
| Toner 13 | 1.53 | 1.10 | 3.53 | 0.72 | 2.31 | 66 | 99.3% |
| Toner 14 | 1.32 | 1.05 | 2.92 | 0.80 | 2.22 | 51 | 98.2% |
| Toner 15 | 0.52 | 0.43 | 2.88 | 0.83 | 5.54 | 26 | 97.5% |
| Toner 16 | 2.97 | 1.08 | 7.22 | 0.36 | 2.43 | 146 | 98.5% |
| Toner 17 | 1.22 | 1.09 | 3.19 | 0.89 | 2.61 | 32 | 92.3% |
| Toner 18 | 1.30 | 1.05 | 3.33 | 0.81 | 2.56 | 55 | 98.6% |
| Toner 19 | 1.29 | 1.06 | 2.85 | 0.82 | 2.21 | 52 | 97.7% |
| Toner 20 | 1.13 | 1.01 | 2.30 | 0.89 | 2.04 | 48 | 96.4% |
| Toner 21 | 1.30 | 1.52 | 3.07 | 1.17 | 2.36 | 74 | 99.5% |
| Toner 22 | 0.48 | 0.38 | 1.06 | 0.79 | 2.21 | 8 | 96.6% |
| Toner 23 | 3.54 | 3.03 | 8.08 | 0.86 | 2.28 | 140 | 99.3% |

Examples 1 to 19 and Comparative Examples 1 to 4

Each of the resulting toners was evaluated by the following methods. The evaluation results are shown in Table 2.

(Heat-resistant Storability)

2.0 g of the toner to be evaluated was weighed into a 50 mL resin cup, and left standing for 120 hours in a thermostatic tank set to 55° C., 10% RH. The degree of toner aggregation was then evaluated according to the following standard.

A: No aggregates observed

B: Aggregates observed, but broken up by shaking the resin cup

C: Aggregates observed, not broken up by shaking the resin cup but broken up by pressing with the fingers D: Aggregates observed, not broken up by pressing with the fingers (toner not completely aggregated, but a mixture of toner powder and aggregates)

E: Toner completely aggregated into a single clump

A color laser printer (HP Color LaserJet 3525dn; HP Inc.) was used as the image-forming apparatus in the following tests. The fixing unit was removed to allow unfixed toner images to be output, and the removed fixing unit was modified so that the fixing temperature, process speed and linear fixing pressure could be adjusted for purposes of the evaluation.

For the toner cartridge, the toner was removed from a cyan cartridge, which was then filled with the toner to be evaluated.

A4 size, 81.4 g/m$^2$ Canon color laser copy paper (Canon Inc.) was used as the image-receiving paper.

(Low-temperature Fixability)

Using the toner to be evaluated, an unfixed toner image 2.0 cm long and 15.0 cm wide (toner laid-on level 1.00 mg/cm$^2$) was formed 1.0 cm from the upper edge of the image-receiving paper in the paper feed direction. This unfixed image was then subjected to a fixing test using the modified fixing unit.

In a normal-temperature, normal-humidity environment (23° C., 60% RH) with the process speed set to 240 mm/s and the linear fixing pressure to 25.0 kgf, the temperature of the fixing roller was raised successively in 5° C. increments from an initial set temperature of 120° C., and the unfixed image was fixed at each temperature.

The evaluation standard for low-temperature fixability is as follows. The low-temperature fixing start point is the lowest temperature at which no low-temperature offset phenomenon (adhesion of part of the toner to the fixing unit) is observed.

A: Low-temperature fixing start point not more than 140° C.

B: Low-temperature fixing start point at least 145° C. and not more than 155° C.

C: Low-temperature fixing start point at least 160° C. and not more than 170° C.

D: Low-temperature fixing start point at least 175° C. and not more than 185° C.

E: Low temperature fixing start point at least 190° C.

(Adhesiveness on Paper)

Using the toner to be evaluated, an unfixed toner image 6.0 cm long by 15.0 cm wide (toner laid-on level 0.50 mg/cm$^2$) was formed 1.0 cm from the upper edge of the image-receiving paper in the paper feed direction. The unfixed image was then fixed using the modified fixing unit in a normal-temperature, normal-humidity environment (23° C., 60% RH) with the process speed set to 240 mm/s, the linear fixing pressure to 25.0 kgf, and the fixing roller temperature to 150° C.

Polyester tape was affixed to the resulting fixed image, 4.9 kPa of load was applied from above, and the tape was then stripped.

The image density before and after tape stripping was measured with a color reflection densitometer (X-Rite 404A: X-Rite, Incorporated), and the image density decrease (%) was calculated.

The evaluation standard for adhesiveness of the toner on the paper is as follows.

A: Image density decrease less than 10.0%

B: Image density decrease at least 10.0% and less than 15.0%

C: Image density decrease at least 15.0% and less than 20.0%

D: Image density decrease at least 20.0% and less than 25.0%

E: Image density decrease at least 25.0%

(Melt Adhesion on Photoreceptor Drum (Drum Melt Adhesion))

10,000 sheets of paper were fed in a normal-temperature, normal humidity environment (23° C., 60% RH). Melt adhesion of the toner on the surface of the photoreceptor drum was then observed with a loupe.

The evaluation standard is as follows.

A: No melt adhesion material on drum surface

B: Melt adhesion material with a diameter of less than 0.10 mm on drum surface

C: Melt adhesion material with a diameter of at least 0.10 mm and less than 0.40 mm on drum surface D: At least 1 and less than 10 pieces of melt adhesion material with a diameter of at least 0.40 mm on drum surface E: At least 10 pieces of melt adhesion material with a diameter of at least 0.40 mm on drum surface

TABLE 2

| Example No. | Toner No. | Heat-resistant storability | Low-temperature fixability: Rank | Low-temperature fixability: Low-temperature fixing start point (° C.) | Adhesiveness on paper: Rank | Adhesiveness on paper: Concentration decrease (%) | Drum melt adhesion |
|---|---|---|---|---|---|---|---|
| 1 | 1 | A | A | 130 | A | 8.5 | A |
| 2 | 2 | A | A | 135 | A | 8.8 | B |
| 3 | 3 | B | A | 140 | A | 9.3 | C |
| 4 | 4 | A | B | 155 | B | 12.7 | A |
| 5 | 5 | A | A | 130 | A | 7.6 | B |
| 6 | 6 | A | C | 160 | C | 15.3 | B |
| 7 | 7 | B | A | 130 | A | 8.6 | C |
| 8 | 8 | A | C | 160 | A | 7.1 | B |
| 9 | 9 | A | A | 135 | C | 18.0 | B |
| 10 | 10 | A | B | 145 | B | 11.3 | A |
| 11 | 11 | A | A | 140 | A | 7.2 | B |
| 12 | 12 | A | B | 150 | C | 19.2 | B |
| 13 | 13 | A | B | 150 | A | 6.8 | C |
| 14 | 14 | A | B | 155 | B | 12.4 | A |
| 15 | 15 | A | B | 145 | B | 14.8 | A |
| 16 | 16 | A | A | 140 | B | 17.7 | B |
| 17 | 17 | A | A | 135 | A | 9.1 | B |
| 18 | 18 | B | C | 160 | A | 8.7 | A |
| 19 | 19 | A | C | 165 | C | 15.5 | A |
| Comparative 1 | 20 | A | D | 180 | D | 22.5 | A |
| Comparative 2 | 21 | D | B | 145 | B | 10.2 | D |
| Comparative 3 | 22 | A | D | 175 | D | 24.4 | A |
| Comparative 4 | 23 | D | A | 130 | D | 23.1 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-078791, filed Apr. 11, 2016, which is hereby incorporated by reference herein in its entirety.

What is claimed is:

1. A toner comprising a toner particle containing a binder resin and a wax, wherein a cross-section of the toner observed under a transmission electron microscope shows at least 5 wax domains having an aspect ratio of at least 5, and the toner satisfies the following formulae (1) to (3):

$$Ps/Pd \leq 0.90 \quad (1)$$

$$2.20 \leq Ph/Pd \quad (2)$$

$$0.50 \leq Pd \leq 3.00 \quad (3)$$

where Pd represents an intensity of the highest absorption peak in a range of 2843 $cm^{-1}$ to 2853 $cm^{-1}$ when an intensity of the highest absorption peak in a range of 3022 $cm^{-1}$ to 3032 $cm^{-1}$ is set to 1.00 in an FT-IR spectrum of the toner obtained by an attenuated total reflectance (ATR) method with an infrared light-incidence angle of 45° using diamond as the ATR crystal;

Ps represents an intensity of the highest absorption peak in a range of 2843 $cm^{-1}$ to 2853 $cm^{-1}$ when an intensity of the highest absorption peak in a range of 3022 $cm^{-1}$ to 3032 $cm^{-1}$ is set to 1.00 in an FT-IR spectrum of the toner obtained by the ATR method with an infrared light-incidence angle of 45° using germanium as the ATR crystal; and Ph represents an intensity of the highest absorption peak in a range of 2843 $cm^{-1}$ to 2853 $cm^{-1}$ when an intensity of the highest absorption peak in a range of 3022 $cm^{-1}$ to 3032 $cm^{-1}$ is set to 1.00 in an FT-IR spectrum of a toner sample obtained by the ATR method with an infrared light-incidence angle of 45° using germanium as the ATR crystal, and the toner sample is obtained by heating the toner at 150° C. for 0.10 seconds and then leaving same to cool to 25° C.

2. The toner according to claim 1, wherein the content of the wax is 2.0 to 30.0 mass parts per 100.0 mass parts of the binder resin.

3. The toner according to claim 1, wherein the binder resin is a styrene acrylic resin.

4. The toner according to claim 1, wherein the wax is a hydrocarbon wax.

5. The toner according to claim 1, wherein the number of wax domains with an aspect ratio of at least 5 in a cross-section of the toner when the toner cross-section is observed under a transmission electron microscope is not more than 150.

6. The toner according to claim 1, wherein the endothermic quantity per unit mass derived from the wax in differential scanning calorimetric (DSC) measurement of the toner is 80 to 100.0% given 100.0% as an endothermic quantity per unit mass of the wax alone in DSC measurement.

7. The toner according to claim 1, wherein the toner particle has a core-shell structure, in which the core contains the binder resin and the wax, and the shell contains a polar resin.

* * * * *